US011577879B2

(12) United States Patent
Kim et al.

(10) Patent No.: US 11,577,879 B2
(45) **Date of Patent: *Feb. 14, 2023**

(54) PACKAGING BOX FOR COOLING

(71) Applicant: Coupang Corp., Seoul (KR)

(72) Inventors: Yoo Suk Kim, Seoul (KR); Yoon Hyung Lee, Seoul (KR); Yoo Lee Son, Seoul (KR); Jun Young Won, Seoul (KR); Ui Gon Kim, Seoul (KR); Jeong Sub Shin, Seoul (KR); Se Young You, Seoul (KR); Tae Yeun Kim, Seoul (KR)

(73) Assignee: Coupang Corp., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/385,674

(22) Filed: Jul. 26, 2021

(65) Prior Publication Data

US 2022/0055790 A1 Feb. 24, 2022

Related U.S. Application Data

(63) Continuation of application No. 17/081,569, filed on Oct. 27, 2020, now Pat. No. 11,104,474.

(30) Foreign Application Priority Data

Aug. 20, 2020 (KR) ..... 10-2020-0104947

(51) Int. Cl.
*B65D 5/24* (2006.01)
*B65D 5/20* (2006.01)
(Continued)

(52) U.S. Cl.
CPC ..... *B65D 5/241* (2013.01); *B65D 5/2076* (2013.01); *B65D 81/3813* (2013.01); *F25D 3/08* (2013.01)

(58) Field of Classification Search
CPC .... B65D 81/18; B65D 5/241; B65D 5/46016; B65D 5/48026; B65D 5/6626;
(Continued)

(56) References Cited

U.S. PATENT DOCUMENTS 5,062,527 A 11/1991 Westerman
6,564,992 B1 * 5/2003 Wegner ..... B65D 5/60 229/117.35

(Continued)

FOREIGN PATENT DOCUMENTS

CN 20942120 U 9/2019
JP H01-152371 U 10/1989

(Continued)

OTHER PUBLICATIONS

International Search Report for PCT/KR2020/011869 dated May 12, 2021.

(Continued)

*Primary Examiner* — Christopher R Demeree
(74) *Attorney, Agent, or Firm* — Knobbe, Martens, Olson & Bear, LLP

(57) ABSTRACT

Provided is a folding packaging cooler box convertible from a box mode to an unfolding mode or vice versa, comprising: a box portion having a bottom portion, sidewall portions and joint portions configured to connect with one another and to form a single plane in the unfolding mode; and a cooling reinforcing portion configured to be inserted to the inside of the box and to form a hexahedron shape together with said box portion when said box portion is converted into the box mode, wherein said cooling reinforcing portion comprises a reinforcing bottom portion configured to form a lower surface and to face the bottom portion of the said box portion upon conversion into the box mode; reinforcing sidewall portions configured to connect with the said reinforcing (Continued)

bottom portion and to face the sidewall portions of said box portion; and reinforcing joint portions configured to join said reinforcing sidewall portions, to be folded to face itself and to be in close contact with the reinforcing sidewall portions, upon conversion into the box mode, and wherein said reinforcing bottom portion, said reinforcing sidewall portions and reinforcing joint portions form a single plane in the unfolding mode.

6 Claims, 21 Drawing Sheets

(51) Int. Cl.
*B65D 81/38* (2006.01)
*F25D 3/08* (2006.01)

(58) Field of Classification Search
CPC .. B65D 81/3816; B65D 5/3678; B65D 81/38; B65D 5/4612; B65D 57/00; Y02W 90/10
USPC ..... 229/117.23, 186, 117.01, 117.12, 138, 229/120.02, 120.04, 120.22, 120.31, 229/120.33, 120.38; 206/545; 220/592.2, 220/592.26
See application file for complete search history.

(56) References Cited

U.S. PATENT DOCUMENTS

| | | | | |
|---|---|---|---|---|
| 6,736,309 | B1 | 5/2004 | Westerman | |
| 10,894,654 | B2 | 1/2021 | Zhuang | |
| 2004/0031842 | A1 | 2/2004 | Westerman | |
| 2006/0011686 | A1 | 1/2006 | Latham | |
| 2011/0180550 | A1 | 7/2011 | Kenneally | |
| 2012/0193365 | A1 | 8/2012 | Humphries et al. | |
| 2014/0000306 | A1 | 1/2014 | Chapman, Jr. | |
| 2016/0376082 | A1* | 12/2016 | Gammons | B65D 57/005 220/592.2 |
| 2017/0267438 | A1 | 9/2017 | Welch | |
| 2020/0140179 | A1* | 5/2020 | Costanzo, Jr. | B65D 5/563 |
| 2020/0270013 | A1* | 8/2020 | Costanzo, Jr. | B65D 5/643 |

FOREIGN PATENT DOCUMENTS

| | | | |
|---|---|---|---|
| JP | H02-036413 | U | 3/1990 |
| JP | 03-090844 | U | 9/1991 |
| JP | 03-126814 | U | 12/1991 |
| JP | H07-2222 | U | 1/1995 |
| JP | H08-011864 | A | 1/1996 |
| JP | H10-035746 | A | 2/1998 |
| JP | 2000-238744 | A | 9/2000 |
| JP | 2002-326670 | A | 11/2002 |
| JP | 2004-123100 | A | 4/2004 |
| JP | 2004-340388 | A | 12/2004 |
| JP | 2005-330002 | A | 12/2005 |
| JP | 2007-290763 | A | 11/2007 |
| JP | 3223494 | U | 9/2019 |
| KR | 10-2017-0018655 | A | 2/2017 |
| KR | 10-2136639 | B1 | 7/2020 |

OTHER PUBLICATIONS

Notice of Preliminary Rejection received in KR 10-2020-0104947, dated Jan. 4, 2021.
Decision of Patent Grant received in KR 10-2020-0104947, dated Mar. 17, 2021.

* cited by examiner

PACKAGING BOX FOR COOLING

CROSS-REFERENCE TO RELATED APPLICATIONS

This application is a continuation of U.S. patent application Ser. No. 17/081,569, filed on Oct. 27, 2020, which claims priority to Korean Application No. 10-2020-0104947, filed Aug. 20, 2020, each of which is incorporated herein by reference in its entirety.

BACKGROUND

Technical Field

This disclosure relates to a packaging cooler box.

Description of the Related Art

Recently, the online business has been flourishing, thereby bringing about a huge surge in food deliveries. For food deliveries, a packaging box is used like in any other conventional deliveries. As the food for deliveries is gradually diversified, the demand for delivery increases for foods that need to be kept refrigerated for a long time. Under the circumstances, in order to deliver such chilled food, the packaging box may have an insulating member attached therein, and thereby exponentially increasing the waste of resources for packaging. Further, even if a packaging box has an insulating member attached therein, the condition of the food upon receipt is frequently deteriorated due to an incomplete cooling function. Accordingly, there is a growing need for a packaging box that can replace a disposable packaging box and has an enhanced cooling function.

Under the circumstances, the inventors of the present disclosure suggested Korean Patent No. 2,136,639 (hereinafter, 'prior art reference'). Despite this prior art reference, as the delivery distance or time increased and the demand for chilled food increased, a further enhanced cooling function was increasingly required. Accordingly, the inventors of the present disclosure researched a method that can have a double cooling structure while using the cooler box of the prior art reference as is.

SUMMARY

Technical Goals

The present disclosure provides a packaging cooler box having a double cooling structure. The present disclosure also provides a packaging cooler box that can provide a reinforced cooling structure for the vulnerable parts in a box mode, embody an automated cleaning of all components in an unfolding mode, and has the components combined with each other in a portable mode for easy portability. The technical problems to be solved by the embodiments of the present disclosure are not limited to the above-mentioned problems, and other technical challenges can be inferred from the following embodiments.

Technical Solutions

According to an aspect to achieve the above technical challenges, there is provided a folding packaging cooler box convertible from a box mode to an unfolding mode or vice versa, comprising: a box portion having a bottom portion, sidewall portions and joint portions configured to connect with one another and to form a single plane in the unfolding mode; and a cooling reinforcing portion configured to be inserted to the inside of the box and to form a hexahedron shape together with said box portion when said box portion is converted into the box mode, wherein said cooling reinforcing portion comprises a reinforcing bottom portion configured to form a lower surface and to face the bottom portion of the said box portion upon conversion into the box mode; reinforcing sidewall portions configured to connect with the said reinforcing bottom portion and to face the sidewall portions of said box portion; and reinforcing joint portions configured to join said reinforcing sidewall portions, to be folded to face itself and to be in close contact with the reinforcing sidewall portions, upon conversion into the box mode, and wherein said reinforcing bottom portion, said reinforcing sidewall portions and reinforcing joint portions form a single plane in the unfolding mode.

According to another aspect, said reinforcing bottom portion, reinforcing sidewall portions and reinforcing joint portions form a single rectangular shape.

According to another aspect, said reinforcing joint portions each have a rounded corner.

According to another aspect, said reinforcing joint portions each face the inside of each joint portion of said box portion, and while said reinforcing joint portions are each folded to face itself, each folded joint portion of said box portion can be inserted to the inside of each reinforcing joint portion.

According to another aspect, the packaging cooler box further includes a compartment which forms a refrigerated space when provided in the inside of said cooling reinforcing portion in the box mode, and said cooling reinforcing portion comprises easy adhesive portions so that the compartment can be attached thereto, as the compartment is rolled down.

According to another aspect, said compartment has an easy adhesive portion at one end, and comprises a mesh portion which can hold a refrigerant.

According to another aspect, while the compartment is rolled down, and thereby a refrigerated space is formed inside, said mesh portion is provided at one surface of said compartment facing the refrigerated space so as to keep the refrigerated space at low temperature.

Details of other embodiments are included in the detailed description and drawings.

Effects

The packaging cooler box of the present disclosure can form a double cooling structure by comprising a cooling reinforcing portion in the inside of the box portion, and thereby maximizing the cooling effect in the interior space of the packaging cooler box.

Further, upon conversion into a box mode, the joint portions can be folded in two layers to face each other, and thereby minimizing the thermal losses in the vulnerable parts.

Further, since the box portion and the cooling reinforcing portion form a single plane in an unfolding mode, an introduction thereof into the cleaning device is easy, and thereby enabling a fully automated cleaning.

Further, since the cooling reinforcing portion can be converted into a portable mode while combined with the box portion, the user can easily grasp or carry the box with its minimized volume.

The effects of the invention are not limited to those described above, and other effects not mentioned here may be clearly understood by those skilled in the art from the descriptions in the claims.

DETAILED DESCRIPTION

Figure 1:
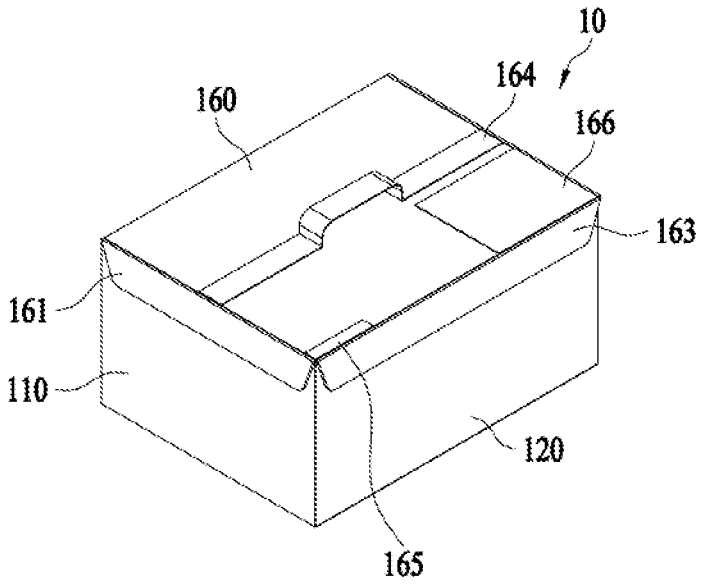
FIG. 1 is a perspective view of an embodiment of a box portion constituting a packaging cooler box according to the present disclosure.

The terms used in the embodiments are selected, as much as possible, from general terms that are widely used at present while taking into consideration the functions obtained in accordance with the present disclosure, but these terms may be replaced by other terms based on intentions of those skilled in the art, customs, emergence of new technologies, or the like. Also, in a particular case, terms that are arbitrarily selected by the applicant of the present disclosure may be used. In this case, the meanings of these terms may be described in corresponding description parts of the disclosure. Accordingly, it should be noted that the terms used herein should be construed based on practical meanings thereof and the whole content of this specification, rather than being simply construed based on names of the terms.

As used herein, the terms "module" and "portion" for the constituent elements of the present disclosure are used or interchangeably used solely for ease of preparation of the specification, and do not have different meanings and each of them does not function by itself. Further, regarding the description of the example embodiments of the present disclosure, the detailed description of the related known technologies may be omitted when such description is determined to possibly confuse the essence of the example embodiments included in the present disclosure. Further, the accompanying drawings are merely to make it easier to understand the embodiments included in the present disclosure and the technical idea of the present disclosure is not limited thereto, and they should be construed to include all of modification, equivalence and replacement involved in the idea and the technical scope of the present disclosure.

The terms including ordinal numbers such as 'first' and 'second' may be used to describe different constituent elements, which are not limited thereto. Said terms are used solely for distinguishing one element from another element.

In the entire specification, when an element is referred to as "joined with" or "connected to" another element, the two different elements may be directly joined with or connected to each other but also have another element between them. On the other hand, when an element is referred to as "directly joined with" or "directly connected to" another element, they should be understood not to have any other element between them.

As used herein, the singular forms are intended to include plural forms as well, unless the context clearly indicates otherwise.

As used herein, the term "comprising" or "having" is intended to indicate that there may be the features, numbers, steps, operations, components, parts or a combination thereof, disclosed in this disclosure, but should not be understood as excluding the case that there is one or more of other features, numbers, steps, operations, components, parts or a combination thereof, or the possibility of adding the same.

The expression "at least one of A, B, and C" may include the following meanings: A alone; B alone; C alone; both A and B together; both A and C together; both B and C together; and all three of A, B, and C together.

In the following description, embodiments of the present disclosure will be described in detail with reference to the drawings so that those skilled in the art can easily carry out the present disclosure. The present disclosure may be embodied in many different forms and is not limited to the embodiments described herein.

Hereinafter, example embodiments of the present disclosure will be described with reference to the drawings.

Figure 2:
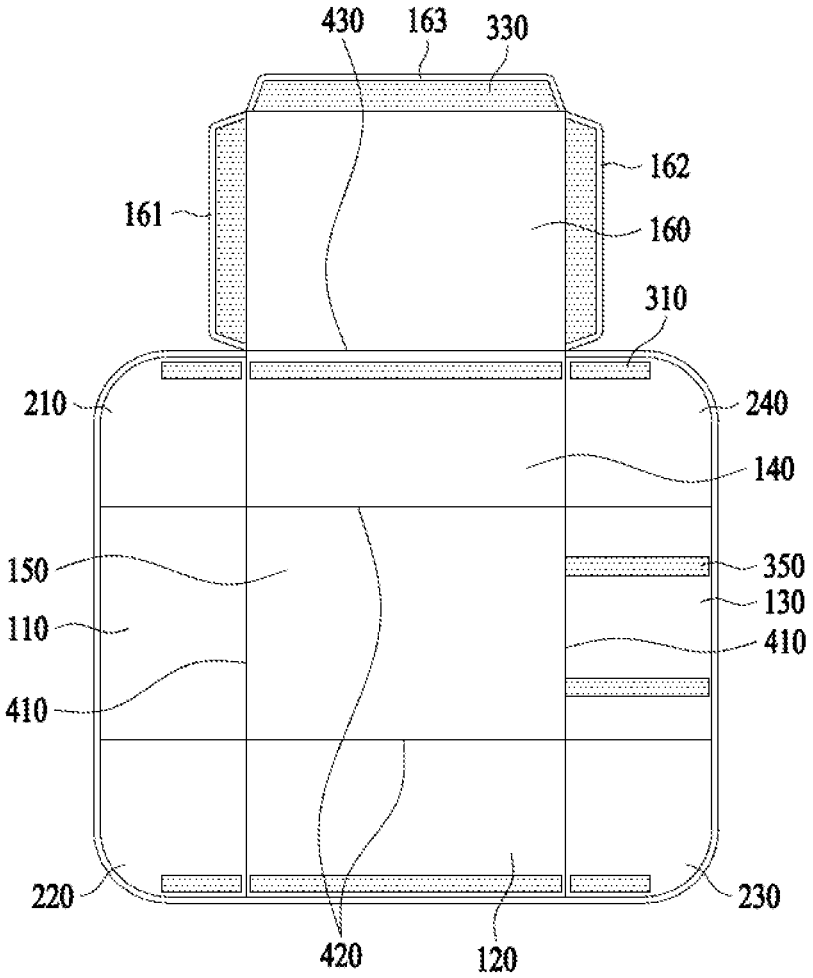
FIG. 2 is an inside view of a template for the box portion of FIG. 1.
Figure 3:
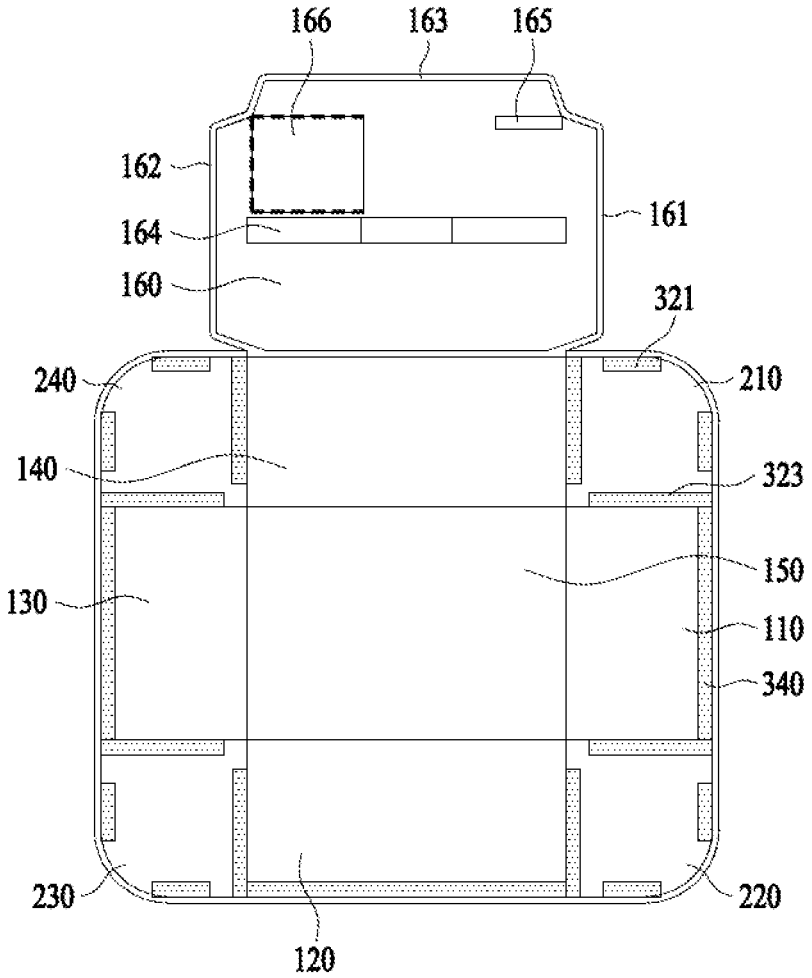
FIG. 3 is an outside view of a template for the box portion of FIG. 1.

FIG. 1 is a perspective view of an embodiment of a box portion constituting a packaging cooler box according to the present disclosure; FIG. 2 is an inside view of a template for the box portion; FIG. 3 is an outside view of a template for the box portion.

The packaging cooler box 10 of the present disclosure consists of a box portion 100 and a cooling reinforcing portion 500.

First, said box portion 100 will be explained, referring to FIG. 1 to FIG. 3. The box portion 100 has a first sidewall portion 110, a second sidewall portion 120, a third sidewall portion 130, and a fourth sidewall portion 140, a bottom portion 150 which is formed to connect with the sidewall portions 110, 120, 130, 140 and forms a lower surface of the packaging cooler box 10 upon assembly into a box mode, and a lid portion 160 which is formed to connect with the fourth sidewall portion 140 and forms an upper surface of the packaging cooler box 10 upon assembly into a box mode. The lid portion 160 faces the bottom portion 150 upon assembly into a box mode.

The first sidewall portion 110 is disposed to face the third sidewall portion 130 upon assembly into a box mode, and the second sidewall portion 120 is disposed to face the fourth sidewall portion 140 that is connected with the lid portion 160 upon assembly into a box mode. Also, the second side portion 120 is disposed to be adjacent to the first sidewall portion 110 and the third sidewall portion 130 upon assembly into a box mode. The fourth sidewall portion 140 is disposed to be adjacent to the first sidewall portion 110 and the third sidewall portion 130 upon assembly into a box mode.

As the sidewall portions 110, 120, 130, 140, the bottom portion 150, and the lid portion 160 are configured to be connected in this way, it is easier to convert the packaging cooler box from an unfolding mode with the box unfolded into a box mode. In the box mode, a space to contain food may be provided therein.

The lid portion 160 may further have flaps 161, 162, 163. The flaps 161, 162, 163 may be formed to continue along the remaining sides of the lid portion 160 except for the side connecting with the fourth sidewall portion 140. An easy adhesive portion 300 may be provided on at least one of the flaps 161, 162, 163. The arrangement and shape of the easy adhesive portion 300 will be described in detail below.

Joint portions 200 are provided between the sidewall portions 110, 120, 130, 140. The joint portions 200 are provided between any two adjacent sidewall portions of the above sidewall portions. The joint portions 200 may be configured to connect with any two adjacent sidewall portions of the above sidewall portions in an unfolding mode. The joint portions 200 may be configured to connect integrally with adjacent sides constituting two adjacent sidewall portions of the above sidewall portions in the unfolding mode.

Specifically, a first joint portion 210 may be configured to connect integrally with adjacent sides each included in the first sidewall portion 110 and in the fourth sidewall portion 140. A second joint portion 220 may be configured to connect integrally with adjacent sides each included in the first sidewall portion 110 and in the second sidewall portion 120. A third joint portion 230 may be configured to connect integrally with adjacent sides each included in the third sidewall portion 130 and in the second sidewall portion 120. And a fourth joint portion 240 may be formed to connect integrally with adjacent sides each constituting the third sidewall portion 130 and the fourth sidewall portion 140.

Specific structures and functions of the joint portions 200 will be described in detail below.

Referring to FIG. 2, a crease portion 400 may be provided at the places where the bottom portion 150 meets the sidewall portions 110, 120, 130, 140 of the box portion 100 constituting the packaging cooler box 10 of the present disclosure. The crease portion 400, as will be explained later, may be provided also in the cooling reinforcing portion 500 constituting the packaging cooler box 10 of the present disclosure.

A first crease portion 410 may be provided at the place where the bottom portion 150 meets the first sidewall portion 110 or the third sidewall portion 130. A second crease portion 420 may be provided at the place where the bottom portion 150 meets the second sidewall portion 120 or the fourth sidewall portion 140. The first crease portion 410 and the second crease portion 420 may be formed to connect with each other, surrounding the edge of the bottom portion 150.

A third crease portion 430 may be provided at the place where the lid portion 160 and the fourth sidewall portion 140 meet. The second crease portion 420 and the third crease portion 430 may be formed in parallel at the places where the bottom portion 150 and the lid portion 160 meet the fourth sidewall portion 140.

Specific structures and functions of the crease portion 400 will be described in detail below.

Referring to FIGS. 2 and 3, the box portion 100 constituting the packaging cooler box 10 of the present disclosure includes an easy adhesive portion 300. The easy adhesive portion 300, as will be explained later, may be provided also in the cooling reinforcing portion 500 constituting the packaging cooler box 10 of the present disclosure.

Here, an easy adhesive portion 300 refers to a member capable of being attached and detached repeatedly for the binding purpose. The easy adhesive portion uses a binding method by which a surface meets another surface to be attached to or detached from each other. In an embodiment, the easy adhesive portion may include Velcro.

Specifically, upon assembly into a box mode, easy adhesive portions 310 may attach the folded joint portions 200 to the sidewall portions. The easy adhesive portion 310 provided on the first joint portion 210 or the fourth joint portion 240 functions to be attached to and detached from the easy adhesive portion 310 provided on the fourth sidewall portion 140. Also, the easy adhesive portion 310 provided on the second joint portion 220 or the third joint portion 230 functions to be attached to and detached from the easy adhesive portion 310 provided on the second sidewall portion 120.

Also, easy adhesive portions 320 may bond the opposing faces as the joint portions 200 are folded, during assembly into a box mode. The easy adhesive portions 320 provided on the first joint portion 210 to the fourth joint portion 240 function to attach and detach the faces that become opposite to each other as each joint portion is folded.

Also, during assembly into a box mode, easy adhesive portions 330, 340 may bond the lid portion 160 to the sidewall portions. The easy adhesive portions 330 may be provided on flaps 161, 162, 163 that are connected integrally with the lid portion 160. At the same time, the easy adhesive portions 340 may be formed on the upper part of the sidewall portions. The easy adhesive portions 340 may be provided on the upper part of the first sidewall portion 110, the second sidewall portion 120, and the third sidewall portion 130, each corresponding to the easy adhesive portions 330 provided on the flaps 161, 162, 163.

Also, easy adhesive portions 350, 360 are provided inside any one of the sidewall portions to bond a compartment 170 thereto. The easy adhesive portion 350 may be provided vertically either on the first sidewall portion 110 or on the third sidewall portion 130, and at the same time, the easy adhesive portion 360 may be provided on both ends of the compartment 170.

The compartment 170, as will be explained later, may be also bound to the inside of the cooling reinforcing portion 500 constituting the packaging cooler box 10 of the present disclosure. In other words, the compartment 170 can be provided inside any one of the sidewall portions of said cooling reinforcing portion 500 while the cooling reinforcing portion 500 is inserted to said box portion 100.

A specific transformation process and functions of the compartment 170 will be described in detail below.

Referring to FIG. 3, a handle 164, a label 165, and an invoice attachment 166 may be provided outside the lid portion 160.

The handle 164 is located at the center of the lid portion 160 so that, when the user pulls up the packaging box 10 in a box mode, the holding capacity applies evenly and prevents the load from sliding to one side.

The label 165 may include a bar code label having delivery information. As such, since the label 165 is provided outside the lid portion 160, it is possible to easily check information through a bar-code scanner, etc., during the delivery process in a box mode.

Also, the invoice attachment 166 may be provided so that an invoice can be inserted therein. The invoice attachment 166 is made up of a plastic pack to facilitate inserting, verifying, and removing the invoice, so that the remaining part (indicated by the dotted line in FIG. 3) other than the insert may be provided to be sewn to the lid portion 160.

According to an embodiment of FIG. 3, the label 165 may be separately provided in a different position from the invoice attachment 166. On the contrary, the label 165 may be provided to be included in the invoice attachment 166.

Figure 4:
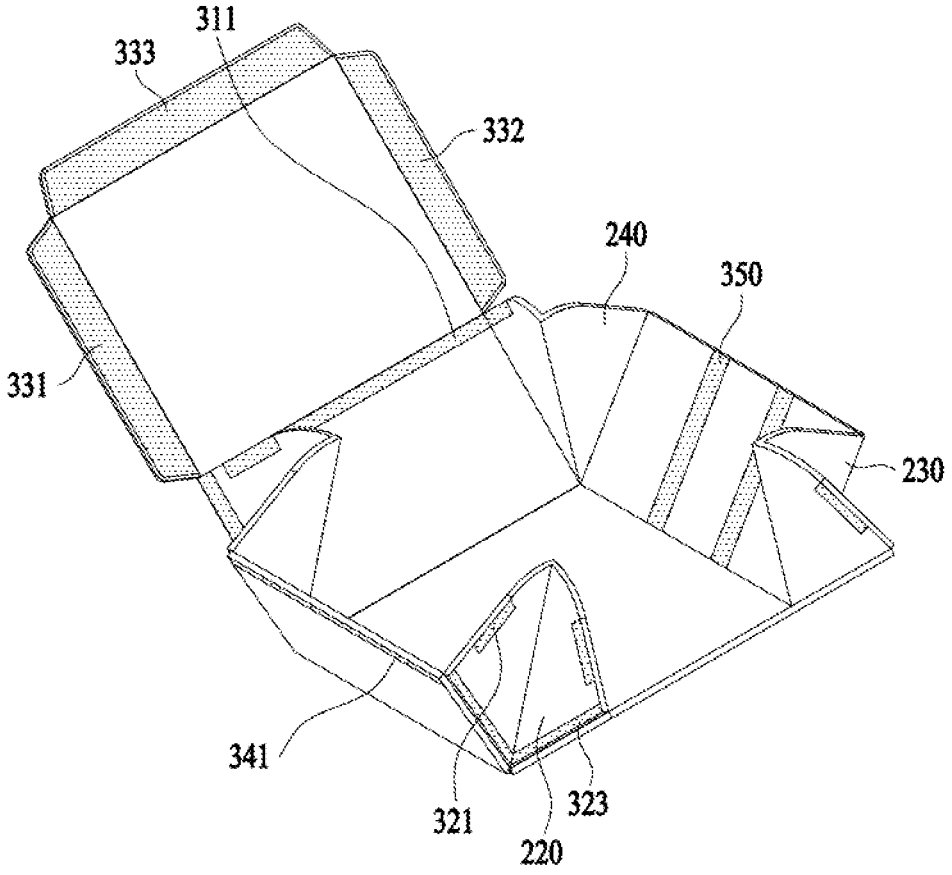
FIG. 4 is a perspective view illustrating a process of assembling the box portion constituting the packaging cooler box of the present disclosure from an unfolding mode to a box mode.

FIG. 4 is a perspective view illustrating a process of assembling the box portion constituting the packaging cooler box of the present disclosure from an unfolding mode to a box mode.

Referring to FIG. 4, the packaging cooler box 10 or the box portion 100 constituting it may be converted from an unfolding mode with the box unfolded (see FIG. 2) to a box mode in which a space to contain food is provided (see FIG. 1) or vice versa.

The sidewall portions 110, 120, 130, 140, bottom portion 150 and lid portion 160, which constitute a hexahedron in the box mode, are configured to be unfolded into a single plane in the unfolding mode. The adjacent sides of the sidewall portions which are located to meet, in the box mode, become apart from each other to be spaced in the unfolding mode. The joint portions 200 are formed in these spaces, and thereby the sidewall portions 110, 120, 130, 140 joined together from the bottom portion 150 as a center may entirely form a single rectangular shape.

Specifically, said first sidewall portion 110 and said fourth sidewall portion 140 each have an adjacent side: the adjacent sides of them meet in the box mode, and become apart as the packing cooler box is converted into an unfolding mode. To join the adjacent sides thus spaced together, the first joint portion 210 is formed. The said first joint portion 210 constitutes a single plane with the first sidewall portion 110 and the fourth sidewall portion 140 in the unfolding mode. In this manner, the second joint portion 220, the third joint portion 230 and the fourth joint portion 240 can each constitute a single plane with the respective adjacent sidewall portions.

As a result, it is possible to provide such a shape that, when the box portion 100 is converted into an unfolding mode and then introduced into the cleaning device, enables a complete cleaning and minimization of obstacles in implementing cleaning automation. Advantages resulting from the cleaning device of the present disclosure will be further explained later.

On the other hand, said joint portions 200 may each have a rounded corner. For example, the first joint portion 210 is configured to be joined with the first sidewall portion 110 and the fourth sidewall portion 140, and the remaining portion of the edge thereof may be rounded. In this manner, the second joint portion 220, the third joint portion 230 and the fourth joint portion 240 are each configured to be joined with the respective adjacent sidewall portions, and the remaining portion of the edge thereof may be rounded. Therefore, the sidewall portions 110, 120, 130, 140 joined together from the bottom portion 150 as a center can integrally form a rounded single rectangular shape with the joint portions 200. Thus, the user can easily handle the box portion 100 in the unfolding mode, and the cleaning automation can be carried out smoothly.

Referring to FIG. 4, the joint portions 200 may be configured to be folded upon conversion from an unfolding mode to a box mode. In other words, the joint portions 200 may maintain the physical connection with the adjacent sidewall portions even upon conversion into the box mode. In the box mode, the place where the adjacent sides of the sidewall portions meet is vulnerable to losses due to heat leakage or heat inflow (hereinafter, collectively referred to as 'thermal losses'). The thermal losses can be effectively prevented by the joint portions 200 configured to be joined with the sidewall portions.

As such, the joint portions 200 provided in the box portion 100 of the present disclosure function so that the cleaning can be carried out smoothly through the cleaning device in the unfolding mode, and they also function, in the box mode, so that the thermal losses in the vulnerable part can be prevented to strengthen the overall cooling function.

Referring to FIG. 4, upon assembly into a box mode, a first sidewall portion 110 and a second sidewall portion 120, which were unfolded, stand upright so that the adjacent sides of each sidewall portion become closer to each other. At this time, the second joint portion 220 joined with the adjacent sides will have a diagonal crease formed therein, along which the second joint portion 220 is overlapped on itself. The second joint portion 220 as folded so as to face itself stands completely upright to be in close contact with the inside of the first sidewall portion 110 or the second sidewall portion 120. This transformation can also be performed in the first joint portion 210, the third joint portion 230 and the fourth joint portion 240 in a same manner. Further, this transformation can also be performed with the first joint portion 210, the third joint portion 230 and the fourth joint portion 240 at the same time.

In addition, as the packaging cooler box is converted from the unfolding mode into the box mode, easy adhesive portions 300 can be provided so that the joint portions 200 can be maintained in the folded position, and the folded joint portions 200 can remain close to the sidewall portions. In other words, the opposing two faces as the joint portions 200 are folded can be adhered to each other by the easy adhesive portions 300 as provided, and the folded joint portions 200 become in close contact with the sidewall portions and can be adhered thereto.

Specifically, referring to FIG. 4, the opposing two faces as the second joint portion 220 is folded can be adhered to each other by the easy adhesive portions 320 provided outside the second joint portion 220.

In an embodiment, easy adhesive portions 323 to bond the folded second joint portion 220 can be formed in the second joint portion 220 along the sides thereof adjacent to the sidewall portions to be symmetric with each other. As such, as the easy adhesive portions 323 are formed along the sides adjacent to the sidewall portions corresponding to the above-mentioned vulnerable part, it can enhance the thermal efficiency and maintain a stable box mode.

In still another embodiment, easy adhesive portions 321 can be formed along the edge of the second joint portion 220 to be symmetric with each other. Since said easy adhesive portions 323 are supplemented, the second joint portion 220 can become in close contact with the sidewall portion to keep more stable attachment thereto.

On the other hand, referring to FIG. 4, the folded fourth joint portion 240 has an easy adhesive portion 310 to be attached to the fourth sidewall portion 140. The fourth sidewall portion 140 has an easy adhesive portion 311 on the top, and the inside of the fourth joint portion 240 has an easy adhesive portion 312 corresponding thereto. In other words, the easy adhesive portion 312 is provided on the part of the inside edge of the fourth joint portion 240, with which the fourth sidewall portion 140 is in close, upon conversion into a box mode. Since the folded joint portion is adhered to the sidewall portion by said easy adhesive portion 310 in the box mode, a space to contain food can be secured in the packing cooler box, without any hindrances.

The easy adhesive portions 310, 320 having such a configuration or shape can be provided on the four joint portions 210, 220, 230, 240 in a same manner. Further, this process of the adhesion while the packaging cooler box is converted into a box mode can be carried out in the four joint portions 210, 220, 230, 240 in a same manner. As such, the four joint portions 200 located between sidewall portions have easy adhesive portions 310, 320 so that they can be folded on themselves while the packaging cooler box is converted into a box mode and remain the shape, and the folded joint portions 200 can be adhered to the inside of the sidewall portions, and thereby the thermal losses due to the gap between the sidewall portions can be reduced and the shape of the box can be securely maintained.

As such, the box portion 100 constituting the packaging cooler box of the present disclosure can be easily converted from an unfolding mode to a box mode or vice versa, and minimize the thermal losses in the vulnerable parts essentially accompanied with the conversion. Further, a fully automated cleaning can be implemented in the unfolding mode, thereby significantly enhancing the recyclability of the packaging box. As a result, the packaging cooler box can replace a disposable packaging box, thereby reducing the waste associated with exponentially increasing demands for delivery. In particular, the recycling of a packaging box for delivery can be achieved also for the delivery foods which require a cooling function.

Figure 5:
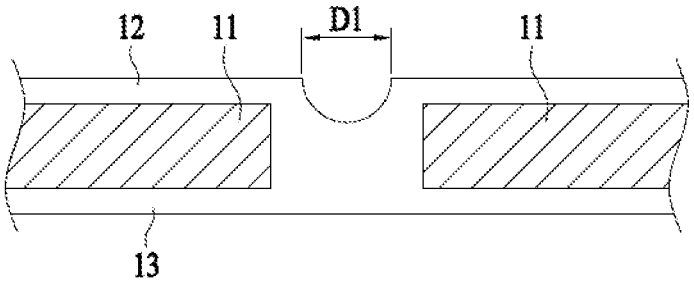
FIG. 5 is a cross-sectional view of an embodiment of a crease portion comprised in the packaging cooler box of the present disclosure, in an unfolding mode.
Figure 6:
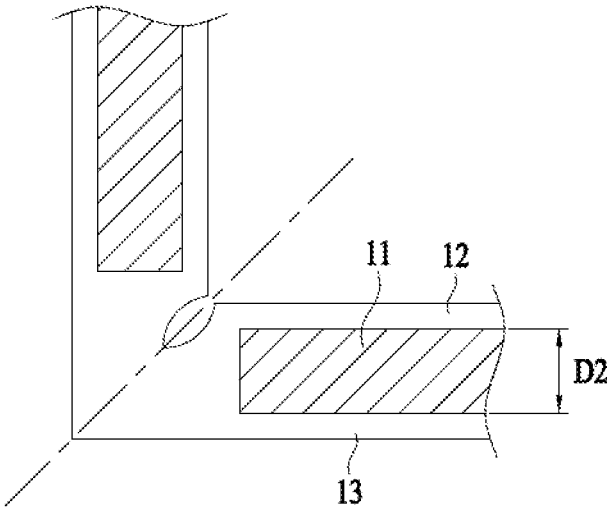
FIG. 6 is a cross-sectional view of an embodiment of a crease portion comprised in the packaging cooler box of the present disclosure, in a folding mode.
Figure 7:
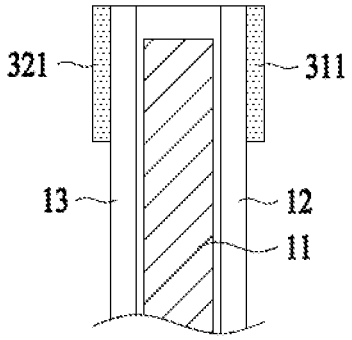
FIG. 7 is a cross-sectional view of an embodiment of a sidewall portion comprised in the packaging cooler box of the present disclosure.

FIG. 5 is a cross-sectional view of an embodiment of a crease portion comprised in the packaging cooler box of the present disclosure, in an unfolding mode; FIG. 6 is a cross-sectional view of an embodiment of a crease portion comprised in the packaging cooler box of the present disclosure, in a folding mode; FIG. 7 is a cross-sectional view of an embodiment of a sidewall portion comprised in the packaging cooler box of the present disclosure.

The cross-sectional structure of the crease portions 400 and the sidewall portions as described below, can be applied to the box portion 100 or cooling reinforcing portion 500 constituting the packaging cooler box 10 of the present disclosure.

The crease portions 400 provided in the box portion 100 will be explained, referring to FIG. 5 to FIG. 7. Said sidewall portions 110, 120, 130, 140, bottom portion 150 and lid portion 160, which constitute a hexahedron in the box mode, have a foam panel 11 therein. Said foam panel 11 may maintain a plate shape and be made of insulating materials for cooling, for example of expanded polypropylene (EPP).

An inner cover 12 and an outer cover 13 may be provided to contain said foam panel 11. Said inner cover 12 may be made of silver or foil for insulation or cooling. Said outer cover 13 may protect the foam panel 11 located inside, prevent from being torn due to an external cause, and be made of a tarpaulin which is waterproof.

FIG. 7 illustrates a cross-sectional view of the upper part of the second sidewall portion 120 where easy adhesive portions 311, 321 are located. Referring to FIG. 7, said easy adhesive portions 311, 321, respectively, may be attached to the faces opposite to the foam panel 11 on the inner cover 12 and on the outer cover 13.

A crease portion 400 may be provided between the sidewall portions 110, 120, 130, 140 and the bottom portion 150, and between the fourth sidewall portion 140 and the lid portion 160 (FIG. 2). Referring to FIG. 5 and FIG. 6, said crease portion 400 may comprise grooves spaced at predetermined intervals (D1). The crease portion 400 having the grooves formed therein has solely the inner cover 12 and the outer cover 13 without the foam panel 11. The crease portion 400 having the grooves formed therein may be configured to have a narrower thickness than the thickness (D2) of the portion in which the foam panel 11 is contained.

The sidewall portions 110, 120, 130, 140 may easily stand upright from the bottom portion 150, and the lid portion 160 also may be easily folded from the fourth sidewall portion 140 in the process of converting into a box mode, due to the foam panels 11 being apart from each other on the said crease portion 400.

In addition, said crease portion 400 has grooves formed therein, and thereby the contaminants in the crease portion 400 may be completely eliminated when cleaning after conversion into an unfolding mode. The contamination of the bottom portion 150 is caused by a part of the food contained in the box mode but leaked therefrom. In particular, the contaminants may be hardened in the crease portions 410, 420 which are located along the edge of the bottom portion 150, and would not easily be removed even in the cleaning device. Since the crease portion 400 has grooves formed therein spaced at predetermined intervals, even when the sidewall portions 110, 120, 130, 140 stand upright from the bottom portion 150 by the conversion into a box mode, a small gap can be secured, and thus the introduced contaminants may be easily removed through the cleaning device without hardening.

Figure 8:
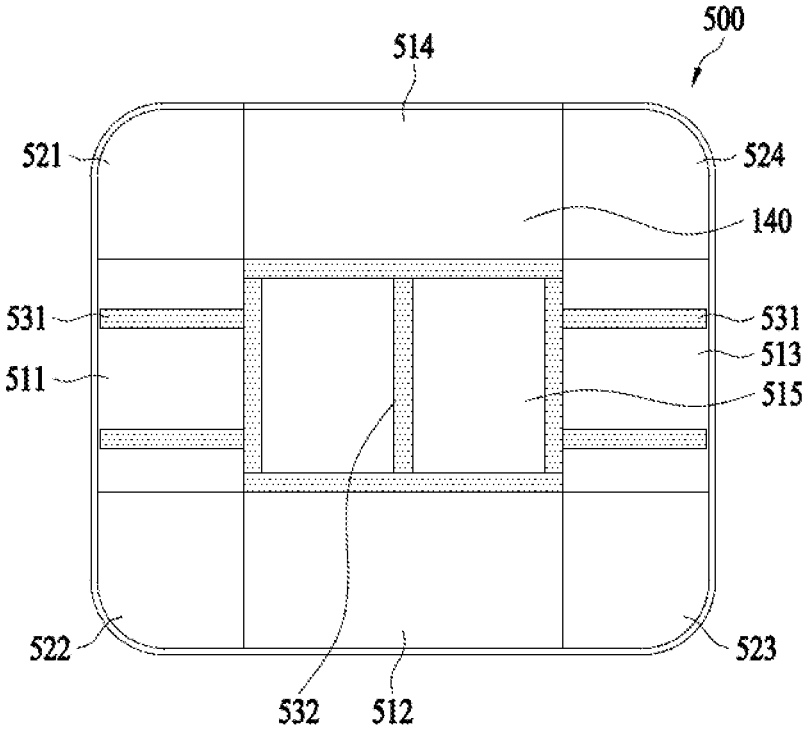
FIG. 8 is an inside view of a template according to an embodiment of a cooling reinforcing portion constituting the packaging cooler box of the present disclosure.
Figure 9:
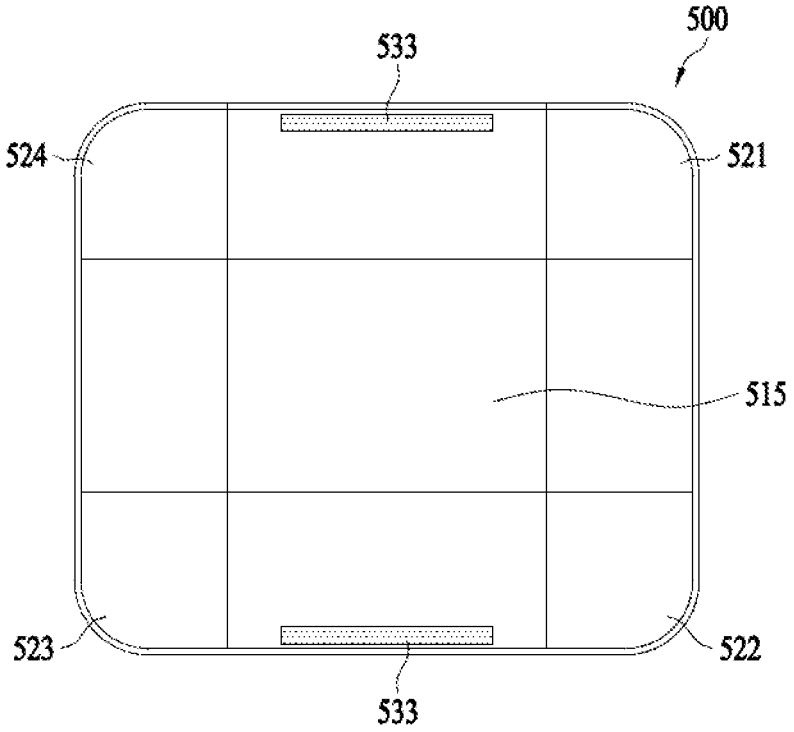
FIG. 9 is an outside view of a template for the cooling reinforcing portion of FIG. 8.
Figure 10:
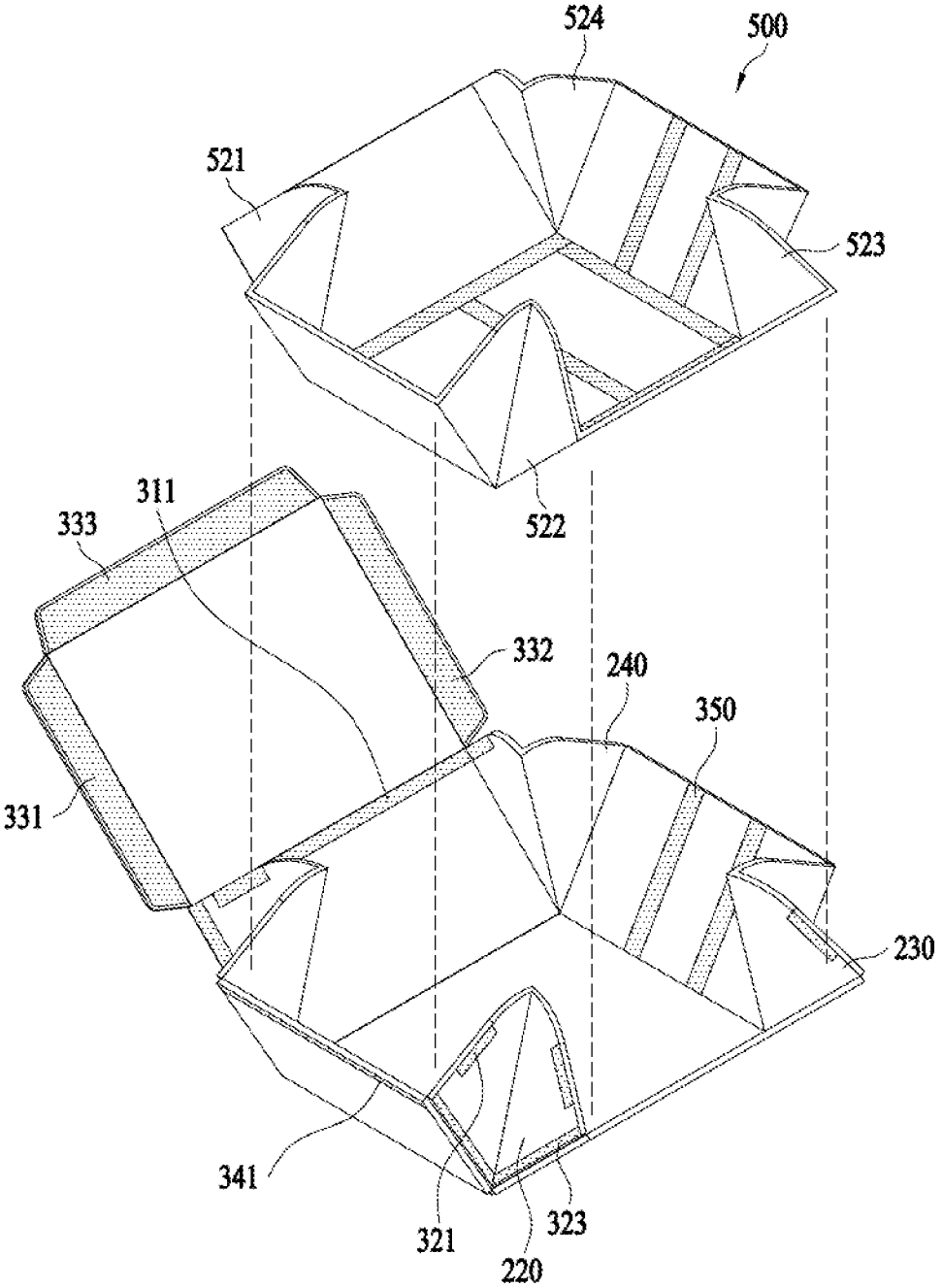
FIG. 10 is a perspective view illustrating a process that the cooling reinforcing portion constituting the packaging cooler box of the present disclosure is inserted into and assembled with the box portion, in an unfolding mode.
Figure 11:
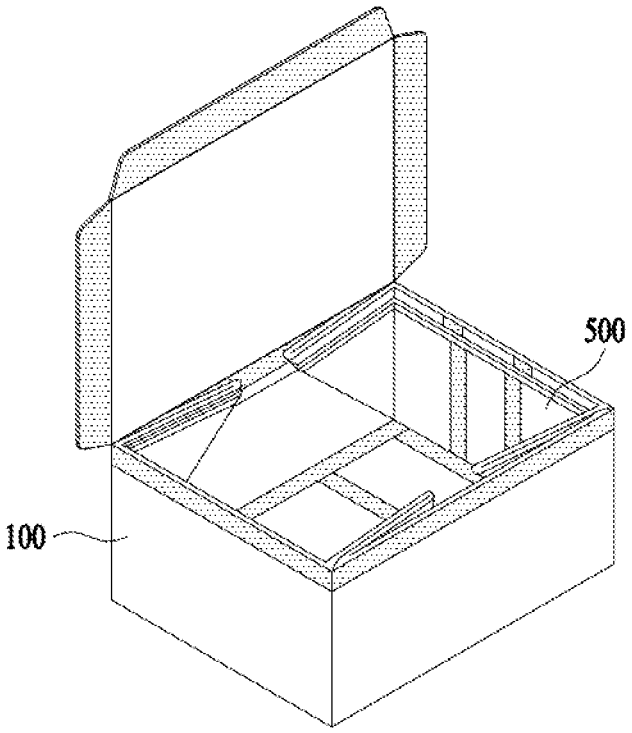
FIG. 11 is a perspective view illustrating an embodiment of a cooling reinforcing portion which has been completely inserted into the box portion during the packaging cooler box of the present disclosure is assembled into the box.

FIG. 8 is an inside view of a template according to an embodiment of a cooling reinforcing portion constituting the packaging cooler box of the present disclosure; FIG. 9 is an outside view of a template for the cooling reinforcing portion; FIG. 10 is a perspective view illustrating a process that the cooling reinforcing portion is inserted into and assembled with the box portion, in the unfolding mode; FIG. 11 is a perspective view illustrating an embodiment of a cooling reinforcing portion which has been completely inserted into the box portion.

The packaging cooler box 10 of the present disclosure comprises a cooling reinforcing portion 500 which is inserted into the inside of the box portion 100, in order to achieve the double cooling structure.

The cooling reinforcing portion 500 has a first reinforcing sidewall portion 511, a second reinforcing sidewall portion 512, a third reinforcing sidewall portion 513, and a fourth reinforcing sidewall portion 514, and a reinforcing bottom portion 515 which is formed to connect with the reinforcing sidewall portions 511, 512, 513, 514 and forms a lower surface when the cooling reinforcing portion 500 is inserted into the inside of the box portion 100 while converted to a box mode.

Further, when the cooling reinforcing portion 500 is inserted to the inside of the box portion 100 while converted into a box mode, said reinforcing bottom portion 515 comes into facing relationship with the bottom portion 150 of the box portion, and said four reinforcing sidewall portions 511, 512, 513, 514 come into facing relationship with the four sidewall portions 110, 120, 130, 140 of the box portion, respectively.

A reinforcing joint portion 520 is provided between said reinforcing sidewall portions 511, 512, 513, 514. The reinforcing joint portion 520 is provided between any two adjacent reinforcing sidewall portions out of said reinforcing sidewall portions. Said reinforcing joint portion 520 can be configured to connect with any two adjacent reinforcing sidewall portions out of said reinforcing sidewall portions in an unfolding mode. Said reinforcing joint portion 520 can be configured to connect integrally with adjacent sides constituting two adjacent sidewall portions out of said reinforcing sidewall portions in an unfolding mode.

Specifically, a first reinforcing joint portion 521 may be configured to connect integrally with adjacent sides each included in the first reinforcing sidewall portion 511 and the fourth reinforcing sidewall portion 514. A second reinforcing joint portion 522 may be configured to connect integrally with adjacent sides each included in the first reinforcing sidewall portion 511 and the second reinforcing sidewall portion 512. A third reinforcing joint portion 523 may be configured to connect integrally with adjacent sides each included in the third reinforcing sidewall portion 513 and the second reinforcing sidewall portion 512. And a fourth reinforcing joint portion 524 may be formed to connect integrally with adjacent sides each constituting the third reinforcing sidewall portion 513 and the fourth reinforcing sidewall portion 514.

Said reinforcing bottom portion 515, said reinforcing sidewall portions 511, 512, 513, 514 and said reinforcing joint portions 521, 522, 523, 524 form a single plane in an unfolding mode. As a result, an introduction thereof into the cleaning device, advantageously, becomes easier, and thereby achieving the cleaning automation of said cooling reinforcing portion 500 through the same device for cleaning the box portion 100.

The reinforcing joint portions 520 are formed, and thereby the reinforcing sidewall portions 511, 512, 513, 514 joined together from the reinforcing bottom portion 515 as a center may form a single rectangular shape. It is possible to provide such a shape that, when the packaging cooler box 10 is converted into an unfolding mode and then introduced into the cleaning device, enables a complete cleaning and minimization of obstacles in implementing cleaning automation.

Said reinforcing joint portions 520 may each have a rounded corner. With the reinforcing joint portions 520 having rounded corners, the reinforcing sidewall portions 511, 512, 513, 514 joined together from the reinforcing bottom portion 515 as a center can form a rounded single rectangular shape. Thus, the user can easily handle the cooling reinforcing portion 500 in the unfolding mode, and the cleaning automation can be carried out smoothly. The cleaning automation will be described more below.

While said cooling reinforcing portion 500 is converted from the unfolding mode into the box mode, said reinforcing joint portion 200 can be folded to face itself. At the same time, said reinforcing joint portion 520 is configured to be in contact with adjacent reinforcing sidewall portion. If the cooling reinforcing portion 500 is inserted to the inside of the box portion 100 and converted into a box mode, as said reinforcing joint portion 520 comes into facing the inside of the joint portion 200 of the box portion, and said reinforcing joint portion 520 is about to be folded to face itself, the folded joint portion 200 of the box portion can be inserted therein. Accordingly, the thermal losses in the vulnerable parts can be minimized by the joint portions folded in two layers.

As such, the cooling reinforcing portion 500 can be converted from an unfolding mode into a box mode together with the box portion 100 as explained earlier. In other words, said cooling reinforcing portion 500 can be inserted to the inside of said box portion in the unfolding mode for cleaning, etc., and can be converted into the box mode for forming a double cooling structure, or vice versa.

The cooling reinforcing portion 500 may comprise an easy adhesive portion. Referring to FIG. 8 and FIG. 9, the easy adhesive portion can be provided on the inside or outside of the cooling reinforcing portion 500.

Specifically, the first reinforcing sidewall portion 511 or the third reinforcing sidewall portion 513 which constitutes the inside of the cooling reinforcing portion 500 may comprise the easy adhesive portion 531 which is provided vertically in a box mode. Further, the reinforcing bottom portion 515 may also comprise an easy adhesive portion 532. A plurality of said easy adhesive portions 532 can be formed at predetermined intervals, and thereby where to fix one end of the compartment 170 can be freely decided. The embodiments depending on where to fix the compartment 170 will be described in detail later.

Further, an easy adhesive portion 533 can be provided at both ends of the cooling reinforcing portion 500. Said easy adhesive portion 533 can be attached to the easy adhesive portion of the box portion 100 in order to be converted to a portable mode. The process how the cooling reinforcing portion 500 is attached in the portable mode will be described in detail later.

As such, the cooling reinforcing portion 500 can be inserted to the inside of the box portion 100, and then embody the double cooling structure easily and effectively. By inserting the cooling reinforcing portion 500, the cooling effect of the interior space of the packaging cooler box can be maximized as compared to a single layered packaging cooler box. The double cooling structure could be also achieved effectively by utilizing the prior art reference suggested by inventors of the present disclosure.

Figure 12:
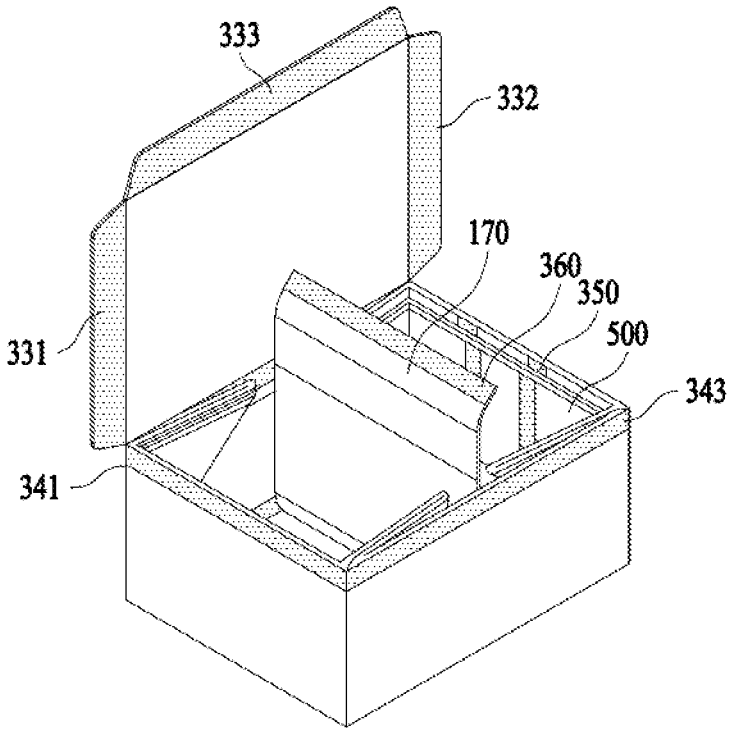
FIG. 12 is a perspective view illustrating an insertion of a compartment during the packaging cooler box of the present disclosure is assembled into the box.
Figure 13:
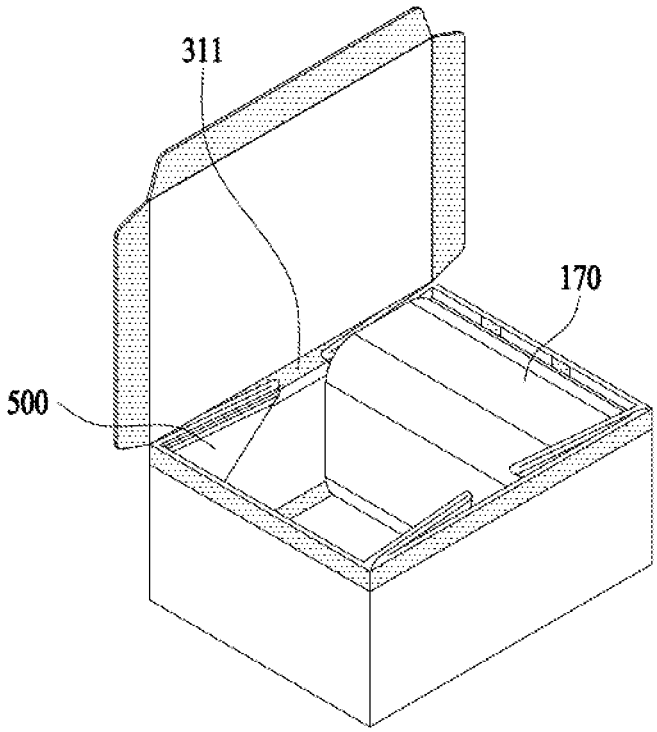
FIG. 13 is a perspective view illustrating an embodiment of a compartment that has been completely inserted during the packaging cooler box of the present disclosure is assembled into the box.
Figure 14:
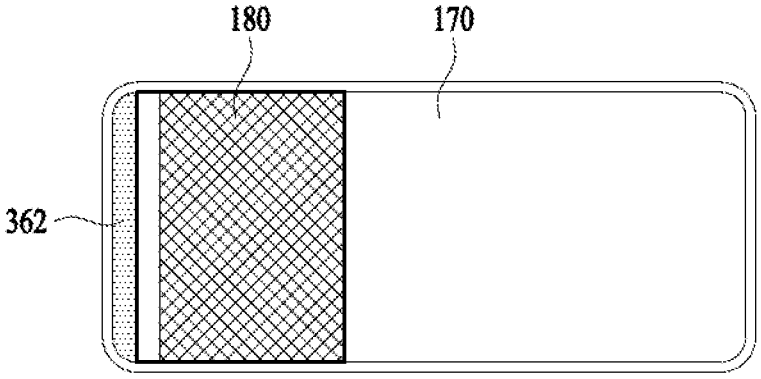
FIG. 14 is a first template illustrating an embodiment of a compartment constituting the packaging cooler box of the present disclosure.
Figure 15:
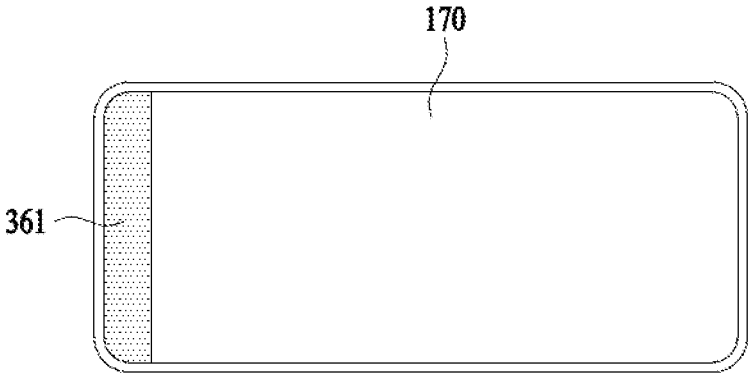
FIG. 15 is a second template illustrating an embodiment of a compartment constituting the packaging cooler box of the present disclosure.
Figure 16:
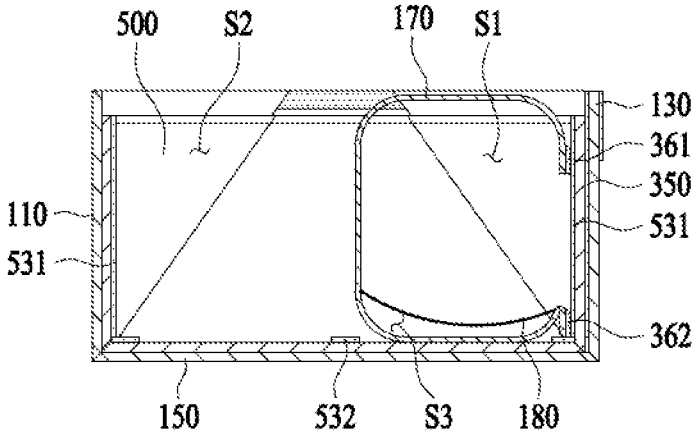
FIG. 16 is a cross-sectional view illustrating an embodiment of a compartment that has been completely inserted in the packaging cooler box of the present disclosure.
Figure 17:
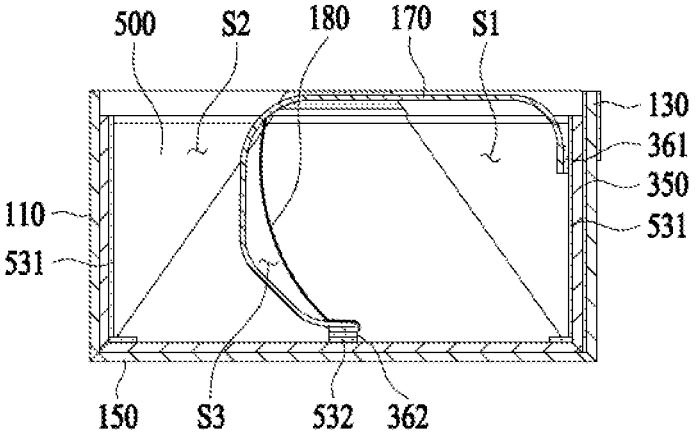
FIG. 17 is a cross-sectional view illustrating another embodiment of a compartment that has been completely inserted in the packaging cooler box of the present disclosure.

FIG. 12 is a perspective view illustrating an insertion of a compartment during the packaging cooler box of the present disclosure is assembled into the box; FIG. 13 is a perspective view illustrating an embodiment of a compartment which has been completely inserted; FIG. 14 is a first template illustrating an embodiment of a compartment constituting the packaging cooler box of the present disclosure; FIG. 15 is a second template illustrating an embodiment of a compartment; FIG. 16 is a cross-sectional view illustrating an embodiment of a compartment which has been completely inserted in the packaging cooler box of the present disclosure; and FIG. 17 is a cross-sectional view illustrating another embodiment of a compartment which has been completely inserted.

Referring to the above drawings, the packaging cooler box 10 may comprise the compartment 170 to separate the internal space in the box mode into a refrigerated space S1 and a room temperature space S2.

Referring to FIG. 14 and FIG. 15, said compartment 170 may consist of a single plane in the unfolded condition. Said compartment 170 may have a rectangular shape, but may be formed to have rounded corners for easy handling by the user.

Said compartment 170 may comprise a mesh portion 180. The mesh portion 180 forms a refrigerant-holding portion S3 which can hold a refrigerant. For example, the refrigerant may be filled in an ice pack. By providing said mesh portion, etc., said compartment 170 can hold the refrigerant at a fixed position, and the refrigerant can be fixed on one surface of said compartment 170 facing the refrigerated space S1. Specifically, said mesh portion 180 can be provided on one surface of said compartment facing the refrigerated space S1 so that said refrigerated space S1 can be maintained at a low temperature condition, in the case that said compartment 170 forms the refrigerated space S1 inside as it is rolled down (FIG. 16 and FIG. 17).

Said compartment 170 may have easy adhesive portions 361, 362 at both ends. Said compartment 170 may be rolled along the longitudinal direction (the transverse direction of FIG. 14). The said compartment 170 may be configured such that the easy adhesive portions 361, 362 provided at both ends thereof can contact one surface as it is rolled down. As a result, a separate space is formed inside the rolled compartment 170, and the cooling power is strengthened by a dual insulation wall in the space. Therefore, an environment is provided in which this space can function as the refrigerated space S1. In other words, said refrigerated space S1 has a dual insulation wall resulting from the compartment 170 and the hexahedron of the packaging box 10, thereby preventing thermal losses such that the chilled food can be stored for a long time. At the same time, by providing said mesh portion 180, the refrigerant can be fixed on the position facing said refrigerated space S1, and thereby stably maintaining the low temperature condition.

On the other hand, the space that is outside the compartment 170 but inside the hexahedron of the packaging box 10 may function as the room temperature space S2 suitable for a long-term storage of the room temperature food. By the compartment 170 provided therein, the packaging box 10 may have inside a space to store the chilled food and a space to store the room-temperature food for a long time at the optimal conditions, at the same time.

In an embodiment of the attachment of the compartment 170, referring to FIG. 16, said compartment 170 can be rolled down such that the easy adhesive portion 361 provided at one end thereof and the easy adhesive portion 362 provided at the other end can be attached to the easy adhesive portion 531 provided in the inside of the cooling reinforcing portion 500 at the same time. In an embodiment, the easy adhesive portion can be provided at one end of the front of the compartment 170 (the first template of FIG. 15) and, at the same time, at the other end of the back (the second template of FIG. 16). Both easy adhesive portions can each be attached to the upper end or the lower end of the easy adhesive portion 531 comprised in the reinforcing sidewall portion of the cooling reinforcing portion 500.

In still another embodiment, referring to FIG. 17, both easy adhesive portions of said compartment 170 can each be attached to the easy adhesive portion 532 comprised in the reinforcing bottom portion of the cooling reinforcing portion 500 or the easy adhesive portion 531 comprised in the reinforcing sidewall portion.

As such, the reinforcing bottom portion also comprises the easy adhesive portion 532 over the entire width, and thereby where to fix one end of the compartment 170 can be decided freely, and thereby securing the refrigerated space S1 having the size or shape as the user desires. In other words, the refrigerated space S1 can be comparted freely in consideration of the shape and size of the chilled food to be contained.

Further, referring to FIG. 12 and FIG. 13, during the user separates the food into the chilled food and the room-temperature food and stores them in the packaging box 10, he/she can put the chilled food first while attaching one end of the compartment 170 to the lower end of the easy adhesive portion 350, and then attach the other end of the compartment 170 to the upper end of the easy adhesive portion 350. Once the compartment 170 is completely attached, the user may put the room-temperature food in the remaining space separated by the compartment 170 to complete the storage of the contents, and right away put the lid portion 160 on, thereby rendering the condition ready to deliver. As such, the easy adhesive portions 360 provided at both ends of the compartment 170 can separate the space through a prompt, easy process and contain the food suitable for each corresponding space at the optimal conditions.

Figure 18:
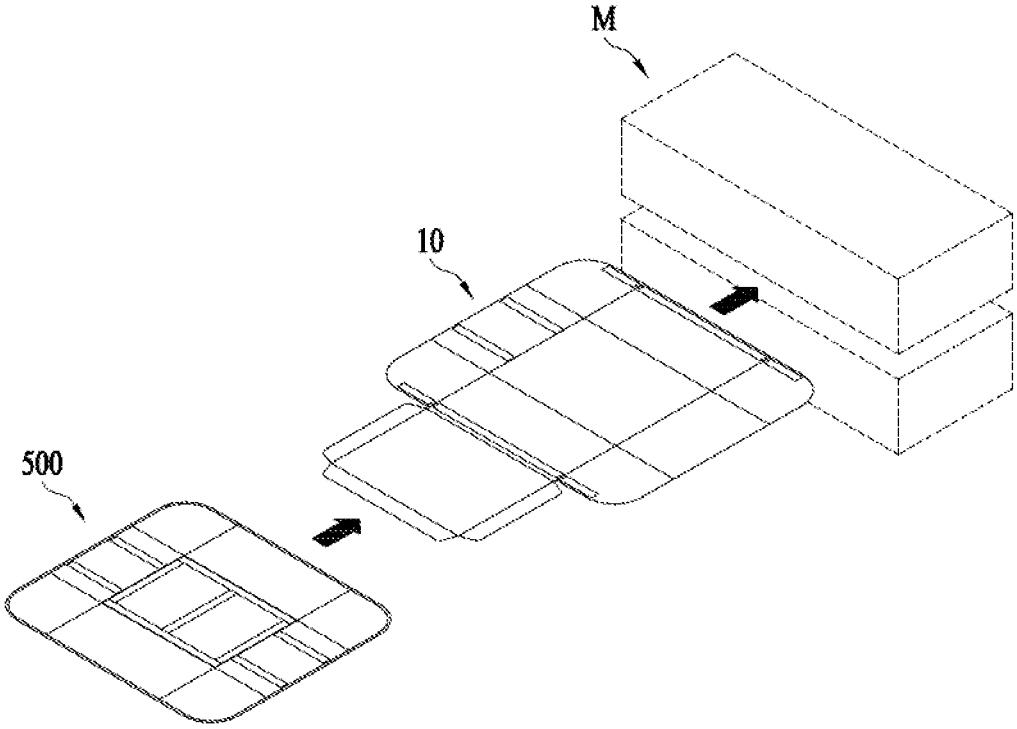
FIG. 18 illustrates cleaning of the box portion and the cooling reinforcing portion constituting the packaging cooler box of the present disclosure, in an unfolding mode.

FIG. 18 illustrates cleaning of the box portion and the cooling reinforcing portion constituting the packaging cooler box of the present disclosure, in an unfolding mode.

Referring to FIG. 18, the box portion 100 and the cooling reinforcing portion 500 are configured such that they can be unfolded into a single plane in the unfolding mode, and the unfolded box portion 100 and the cooling reinforcing portion 500 may be introduced into the cleaning device M to implement an automated cleaning.

The cleaning device M is configured such that the inside and outside surfaces of the unfolded part may be automatically cleaned as the box portion 100 and the cooling reinforcing portion 500 in the unfolding mode pass through the cleaning device M at a particular direction (direction of the arrow in FIG. 18). At this time, the cleaning process may become easy and complete when the box portion 100 and the cooling reinforcing portion 500 are a single plane and has a simple shape such as a rectangle. In the case of a single plane with a complex shape such as a cross or a shape having protrusions, the obstacles increase in implementing an automated cleaning, such as jamming during the cleaning process.

In other words, if the joint portions 200 and the reinforcing joint portions 520 are not provided, and thus the adjacent sides of the sidewall portions are formed to be apart from each other in the unfolding mode of the box portion 100 and the cooling reinforcing portion 500, the first sidewall portion 110 and the reinforcing sidewall portion 510 would work as protrusions during they are introduced into the cleaning device M, and deteriorate the cleaning process.

As such, the box portion 100 and the cooling reinforcing portion 500 according to the present disclosure have the joint portions and reinforcing joint portions joining the adjacent sidewall portions and reinforcing sidewall portions, respectively, to simplify the shape in the unfolding mode into a rectangle, thereby achieving a perfect cleaning optimized to the cleaning device M.

Figure 19:
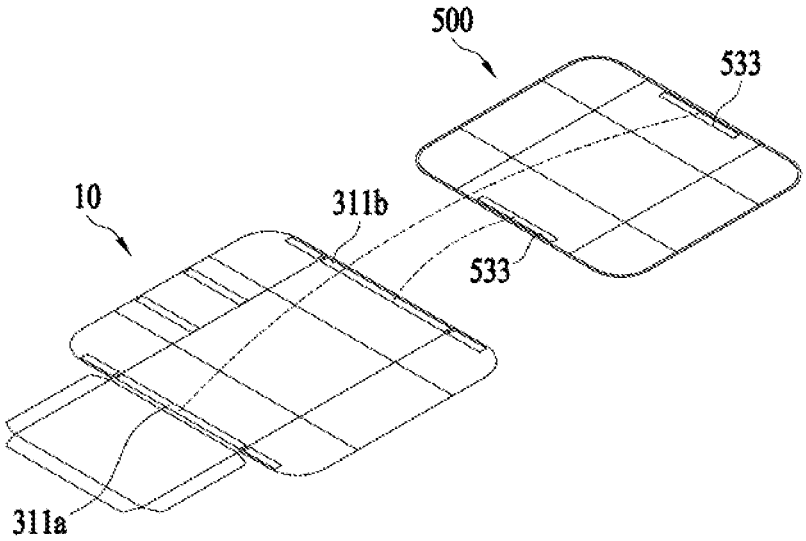
FIG. 19 is a perspective view illustrating a first step of assembling the packaging cooler box of the present disclosure from an unfolding mode to a portable mode.
Figure 20:
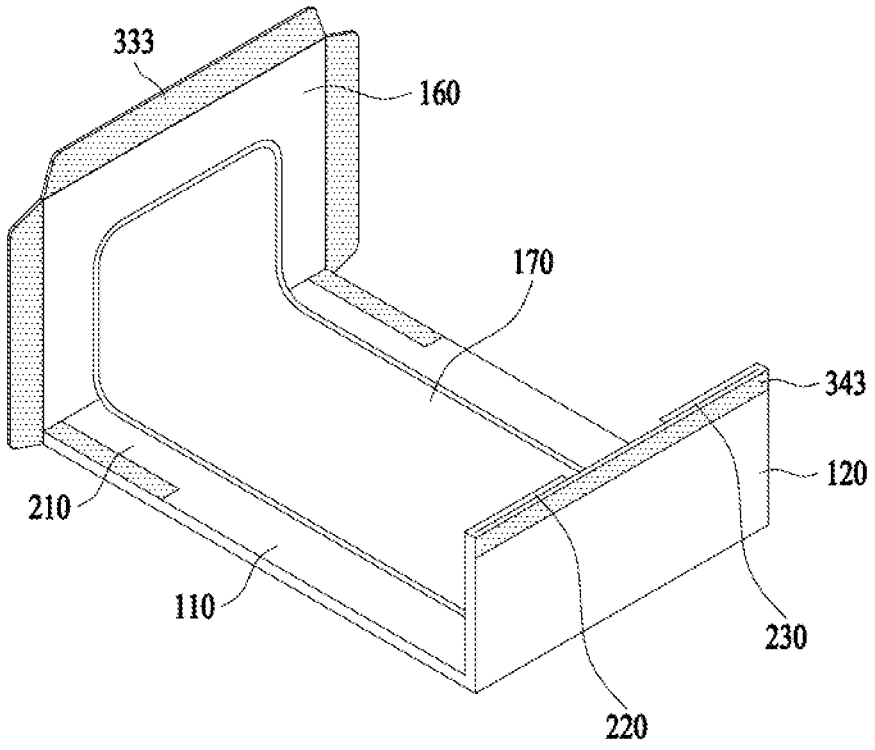
FIG. 20 is a perspective view illustrating a second step of assembling the packaging cooler box of the present disclosure from an unfolding mode to a portable mode.
Figure 21:
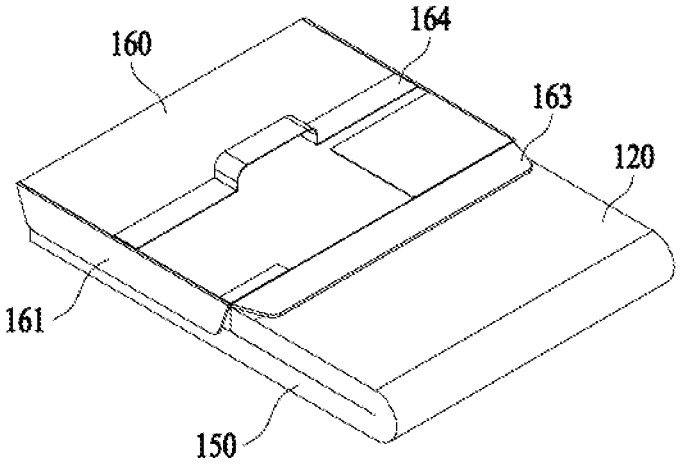
FIG. 21 is a perspective view illustrating the packaging cooler box of the present disclosure that has been completely assembled into a portable mode.

FIG. 19 is a perspective view illustrating a first step of assembling the packaging cooler box of the present disclosure from an unfolding mode to a portable mode; FIG. 20 shows a second step; and FIG. 21 is a perspective view illustrating the packaging cooler box which has been completely assembled into a portable mode.

The packaging cooler box 10 according to the present disclosure can be converted into the portable mode. The packaging cooler box 10 in such a portable mode may be utilized, for example, when the delivery is completed, the content therein is removed from the packaging box, and then the volume and size thereof may be minimized to be delivered back to the shipping company.

Now, the process of converting from the unfolding mode to the portable mode with respect to the box portion 100 and the cooling reinforcing portion 500 constituting said packaging cooler box 10 will be explained.

In the first step, referring to FIG. 19, the cooling reinforcing portion 500 can be combined with the box portion 100. In other words, based on the outside of said cooling reinforcing portion 500 (FIG. 9), the easy adhesive portions 533 formed on the upper end and lower end can be attached to one of the easy adhesive portions 311*b* formed on the upper end portions of the second sidewall portion 120 to the fourth sidewall portion 140 of said box portion 100.

Said easy adhesive portion 311*b* can be provided over the entire width of the second sidewall portion 120 or the fourth sidewall portion 140 from side to side. That is, the easy adhesive portion 311 provided on the said second sidewall portion 120 or the fourth sidewall portion 140 can be configured to be extended to the middle part of the second sidewall portion 120 or the fourth sidewall portion 140 beyond the part corresponding to the joint portion which can be attached to or separated from itself, or configured to be connected at the middle part.

According to the attachment structure of the compartment 170 as will be explained later, said compartment 170 can be attached to the easy adhesive portion 311*b* of the second sidewall portion 120, and preferably, the said cooling reinforcing portion 500 can be attached to the easy adhesive portion 311*b* of the fourth sidewall portion 140.

According to the above embodiment, the easy adhesive portion 533 which is provided at one end of the cooling reinforcing portion 500 during conversion into the portable mode can be attached to the easy adhesive portion 311*b* of the fourth sidewall portion 140. Although the joint portions are folded inward, a part of the easy adhesive portion 311*b* may be exposed in the extended middle part, and the cooling reinforcing portion 500 may be fixed to the exposed part of the easy adhesive portion 311, and can be contained securely without falling out in the portable mode.

In the second step, referring to FIG. 20, fold the first sidewall portion 110 and the third sidewall portion 130 along with the adjacent first joint portion 210 to the fourth joint portion 240 inward, while the cooling reinforcing portion 500 is attached to the box portion 100. Next, put the detached compartment 170 in the place that the first sidewall portion 110, the third sidewall portion 130, etc. are folded inward. At this time, the one end of the compartment 170 may be attached to the second sidewall portion 120. Then, fold the second sidewall portion 120 inward. Then, folding the lid portion 160 inward, attach an easy adhesive portion 333 provided on the flap 163 to an adhesive portion 343 provided outside the second sidewall portion 120.

Referring to FIG. 21, the upper part of the packaging box 10 which is completely converted into the portable mode still has the handle 164 located in and exposed from the center of the lid portion 160, and thus the user can easily grasp the handle 164 to move the packaging box 10.

On the other hand, the function of fixation of the compartment 170 in the portable mode will be explained in detail as follows: the easy adhesive portion 311*b* can be provided on the fourth sidewall portion 140 over the entire width thereof from side to side. That is, the easy adhesive portion 311 provided on the said second sidewall portion 120 can be configured to be extended to the middle part of the fourth sidewall portion 140 beyond the part corresponding to the easy adhesive portions 312 provided on the joint portion which can be attached to or separated from itself, or configured to be connected at the middle part.

As a result, it can be attached to the easy adhesive portion 361 provided at one end of the compartment 170 during the mode is converted into the portable mode. Although the joint portions are folded inward, a part of the easy adhesive portion 311 may be exposed in the extended middle part, and the compartment 170 may be fixed to the exposed part of the easy adhesive portion 311, and can be contained securely without falling out in the portable mode.

Said compartment 170 can be attached to an easy adhesive portion 331*b* provided on the upper end of the second sidewall portion 120, and said cooling reinforcing portion 500 is attached to an easy adhesive portion 331*b* provided on the upper end of the fourth sidewall portion 140, and thereby the compartment 170 and the cooling reinforcing portion 500 can be converted into the portable mode while they are stably combined with the box portion 100. As a result, the user can easily grasp or carry the packaging cooler box 10 consisting of the cooling reinforcing portion 500, the box portion 100, etc. with its minimized volume.

The above-described embodiments are merely examples and other embodiments may be implemented within the scope of the following claims.

DESCRIPTION OF THE REFERENCE NUMERALS

10: packaging cooler box
100: box portion
170: compartment
180: mesh portion
200: joint portion
300: easy adhesive portion
400: crease portion
500: cooling reinforcing portion
511, 512, 513, 514: reinforcing sidewall portions
515: reinforcing bottom portion
521, 522, 523, 524: reinforcing joint portions
531, 532, 533: easy adhesive portion
S1: refrigerated space
S2: room temperature space
S3: refrigerant insertion
M: cleaning device

What is claimed is:

1. A folding packaging cooler box convertible from a box mode to an unfolding mode or vice versa, comprising:

a box portion having a bottom portion, sidewall portions and joint portions configured to connect with one another and to form a single plane when the cooler box is in the unfolding mode; and a cooling reinforcing portion configured to be inserted into the inside of the box portion and to form a hexahedron shape together with the box portion when the cooler box portion is in the box mode, wherein the cooling reinforcing portion comprises:

a reinforcing bottom portion configured to form a lower surface and to face the bottom portion of the box portion when the cooler box is in the box mode;

reinforcing sidewall portions configured to connect with the reinforcing bottom portion and to face the sidewall portions of the box portion; and reinforcing joint portions configured to join the reinforcing sidewall portions, be folded to face itself, and be in close contact with the reinforcing sidewall portions when the cooler box is in the box mode, wherein the reinforcing bottom portion, the reinforcing sidewall portions and the reinforcing joint portions form a single plane when the cooler box is in the unfolding mode, wherein each of the reinforcing joint portions face the inside of each joint portion of the box portion, while each of the reinforcing joint portions fold to face itself, each of folded joint portions of the box portion can be inserted to the inside of each reinforcing joint portion, and the reinforcing joint portions each are in close contact with each adjacent reinforcing sidewall portions, as the joint portions are inserted.

2. The packaging cooler box of claim 1, wherein the reinforcing bottom portion, the reinforcing sidewall portions, and the reinforcing joint portions form a single rectangular shape.

3. The packaging cooler box of claim 2, wherein each of the reinforcing joint portions has a rounded corner.

4. The packaging cooler box of claim 1, wherein the packaging cooler box further includes a compartment which forms a refrigerated space when provided in the inside of the cooling reinforcing portion in the box mode, and the cooling reinforcing portion comprises easy adhesive portions so that the compartment can be attached thereto, as the compartment is rolled down.

5. The packaging cooler box of claim 4, wherein the compartment comprises an easy adhesive portion at one end, and a mesh portion which can hold a refrigerant.

6. The packaging cooler box of claim 5, wherein while the compartment is rolled down, and thereby a refrigerated space is formed inside, the mesh portion is provided at one surface of the compartment facing the refrigerated space so as to keep the refrigerated space at low temperature.

* * * * *